United States Patent [19]

Sevey

[11] Patent Number: 4,681,381

[45] Date of Patent: Jul. 21, 1987

[54] REMOVABLE DRAWER SLIDE AND INTERLOCK WITH DRAWER

[75] Inventor: Douglas Sevey, Waterloo, Iowa

[73] Assignee: Waterloo Industries, Inc., Waterloo, Iowa

[21] Appl. No.: 919,686

[22] Filed: Oct. 16, 1986

[51] Int. Cl.[4] ..... A47B 88/00

[52] U.S. Cl. ..... 312/333; 312/348; 312/350

[58] Field of Search ..... 312/333, 330 R, 350, 312/349, 341 R, 348; 308/3.6

[56] References Cited

U.S. PATENT DOCUMENTS

| | | | |
|---|---|---|---|
| 700,721 | 5/1902 | Ames | 312/330 R |
| 1,247,712 | 11/1917 | Ohnstrand | 312/330 R |
| 1,477,278 | 12/1923 | O'Connor | 312/348 |
| 1,569,158 | 1/1926 | Tobey | 312/350 |
| 1,958,686 | 5/1934 | Vanderhoof | 312/350 |
| 2,528,910 | 11/1950 | Poe | 312/333 |
| 2,859,070 | 11/1958 | Gomersall | 312/333 |
| 3,092,429 | 6/1963 | Barnes | 312/333 |
| 3,123,419 | 3/1964 | Maxwell | 312/333 |
| 3,124,402 | 3/1964 | Rhoads | 312/350 |
| 3,572,874 | 3/1971 | Hassel | 312/350 |
| 3,624,703 | 11/1971 | Pavek | 312/350 |
| 4,065,196 | 12/1977 | Stein | 312/333 |
| 4,090,753 | 5/1978 | Rock et al. | 312/330 R |
| 4,191,436 | 3/1980 | Cherry | 312/330 R |

FOREIGN PATENT DOCUMENTS

| | | | |
|---|---|---|---|
| 0910103 | 11/1962 | United Kingdom | 312/350 |
| 1433736 | 4/1976 | United Kingdom | 108/53.5 |

*Primary Examiner*—Kenneth J. Dorner
*Assistant Examiner*—Gerald A. Anderson
*Attorney, Agent, or Firm*—Allegretti, Newitt, Witcoff & McAndrews, Ltd.

[57] ABSTRACT

A drawer with an interlocking drawer slide mechanism is disclosed. The mechanism includes a pair of slides, each attached to one side of the drawer and mateable with a slide receiver. Each slide receiver has a pair of guide pins. A plurality of slide receiver supports are provided having openings mateable with the guide pins such that the slide receivers are supported by the slide receiver supports. Each slide receiver includes a slide lock having a drawer catch. A pair of rotatable drawer stops mounted on the drawer releasably catch the drawer catch to hold the drawer in the mechanism.

7 Claims, 13 Drawing Figures

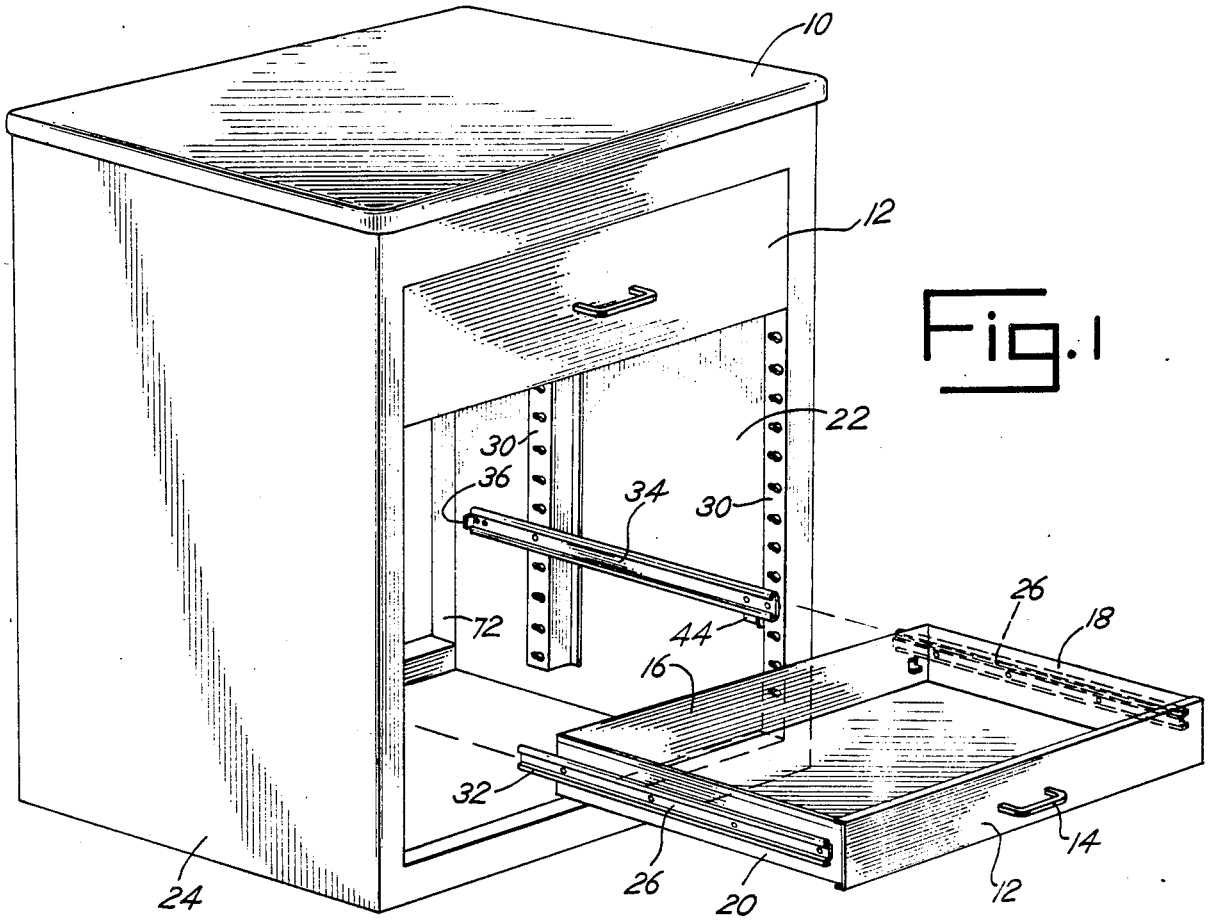
Fig. 1
Fig. 2
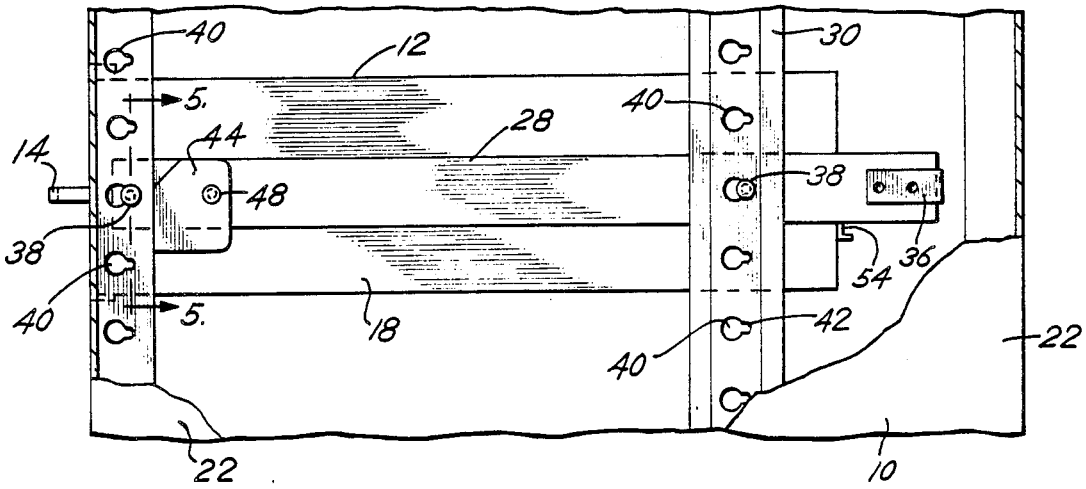

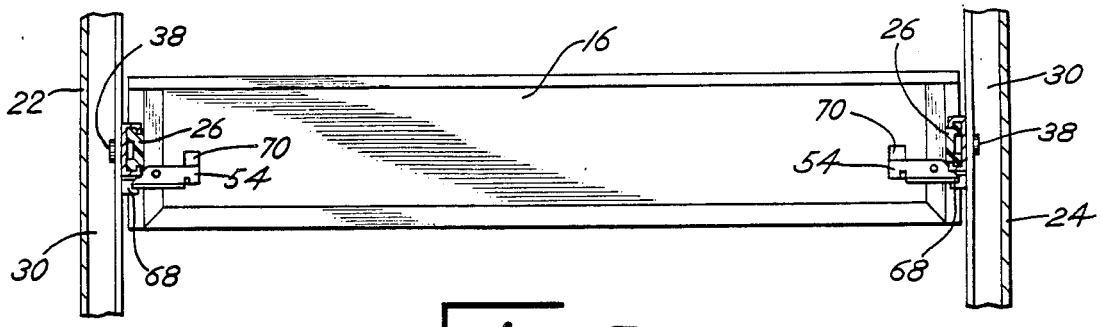
Fig. 7
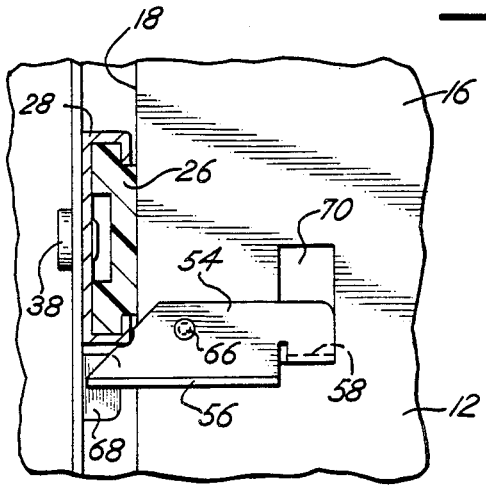
Fig. 8
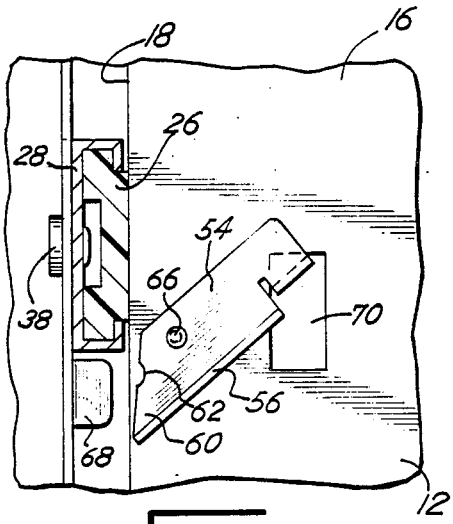
Fig. 9
Fig. 10
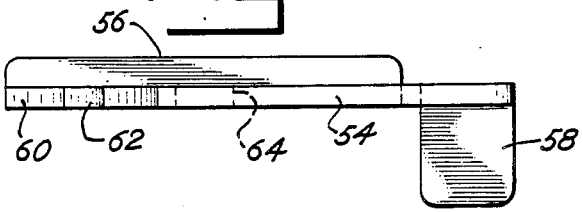
Fig. 12
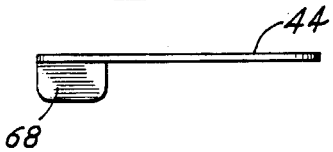
Fig. 11
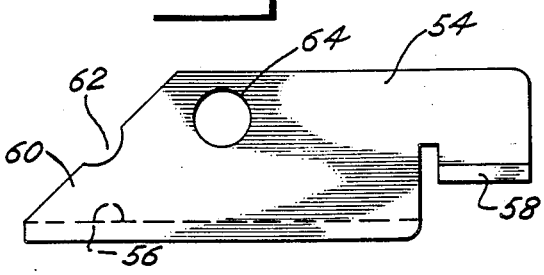
Fig. 13
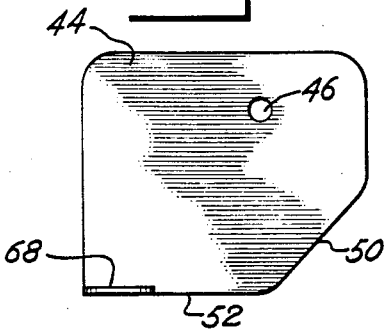

REMOVABLE DRAWER SLIDE AND INTERLOCK WITH DRAWER

BACKGROUND OF THE INVENTION

This invention relates to mechanisms for drawers contained in cabinets or the like, and more particularly relates to an improved mechanism for the interlock of a drawer with a removable and adjustable drawer slide.

Although drawer slides and mechanisms for connecting drawers to such slides are commonplace, the most frequent structures used in the industry for such drawers and slides are relatively complex. In almost all instances, cabinets or other furniture adapted to carry drawer are designed for a single number of drawers to be contained in the cabinet, and can not be modified to carry variable numbers of drawers of variable sizes placed in variable positions.

Various prior art structures have been created that allow drawer slides to be retained in multiple positions. For example Ames, U.S. Pat. No. 700,721 issued May 27, 1902 for a "Refrigerator Case" discloses a support shelf that is movable to a variety of different positions in a refrigerator case. Rock, et al., U.S. Pat. No. 4,090,753 issued May 23, 1978 for a "Fastening Device", discloses a slide support device for an adjustable front panel of pull-out furniture parts, such drawers. Rock is designed to cooperate with the conventional roller type drawer slide mechanism. Ohnstrand, U.S. Pat. No. 1,247,712 issued Nov. 27, 1917 for "Furniture" discloses a construction for furniture such as a desk where drawer slides are removable and cooperate with various slots in a sheet metal cabinet.

Each of the above patents addresses the need for adjustable drawer slide mechanisms, and to some extent address the desire for simplicity of drawer slide mechanisms. However, in each instance the various mechanisms, while effective in providing useful drawer mechanisms, lack either the desired simplicity or the complete flexibility appropriate for an interchangeable drawer slide mechanism.

OBJECTS OF THE INVENTION

It is therefore an object of this invention to provide a drawer slide mechanism with drawer and slide interlock that is simple and comprised of a relatively few number of parts.

Another object of this invention is to provide a drawer and interlocking drawer slide mechanism that allows the position of the drawer slides and hence the configuration of drawers and the cabinet to be readily adjusted.

A further object of this invention is to provide a drawer slide mechanism and interlocking drawer that is relatively easy to operate and adjust.

Yet another object of this invention is to provide a drawer and interlocking drawer slide mechanism that is simple and inexpensive to fabricate.

Still another object of this invention is to provide a drawer and interlocking drawer slide mechanism that, although adjustable, may be easily secured in place such that the mechanism will not dislodge under relatively heavy use.

Another object of this invention is to provide a drawer slide mechanism that adapts itself to use in a wide variety of different drawer constructions, cabinets, and other furniture.

SUMMARY OF THE INVENTION

These and other objects of the invention are achieved by providing a drawer with an interlocking drawer slide mechanism. The mechanism includes a pair of slides, each attached to one side of the drawer. Each slide is mateable with a slide receiver, and each slide receiver has a pair of guide pins that are adapted to support the slide receivers. A plurality of slide receivers supports with openings mating with the guide pins are used to support the slide receivers when the guide pins are inserted into any of a plurality of openings in the slide receiver supports. Each slide receiver has a slide lock rotatably mounted on the receiver. The slide locks move between a "lock" position when secured against one of the slide receivers supports, and an "open" position when away from the same support. Each slide lock also has a drawer catch. The mechanism includes a pair of drawer stops each rotatably mounted on the drawer and moving between a catch position where part of the drawer stop catches the drawer catch and a release position, allowing the drawer to be removed from the slide receiver without the drawer stop contacting the drawer catch of the slide lock.

BRIEF DESCRIPTION OF THE DRAWINGS

FIG. 1 is a perspective view of a drawer, drawer slide, slide receiver, and slide receiver support, all adapted to be mounted in a cabinet.

FIG. 2 is a cut-away side view of the right side of the cabinet shown in FIG. 1, illustrating the slide receiver supports and their attachment to the slide receiver.

In FIG. 6, the front of the cabinet is to the right.

FIG. 7 is a horizontal rear sectional view of a drawer having drawer stops interacting with the drawer catches of the slide locks.

FIG. 8 is an expanded view of the left side portion of the illustration of FIG. 7 showing details of a drawer stop held by the drawer catch of a slide lock.

FIG. 9 is an expanded view of the left side portion of FIG. 7 showing a drawer stop in the release position.

FIG. 10 is a top view of a typical drawer stop.

FIG. 11 is a front view of the drawer stop of FIG. 10.

FIG. 12 is top view of typical slide lock.

FIG. 13 is a front view of the slide lock of FIG. 12.

DETAILED DESCRIPTION OF THE PERFERRED EMBODIMENT

Figure 3:
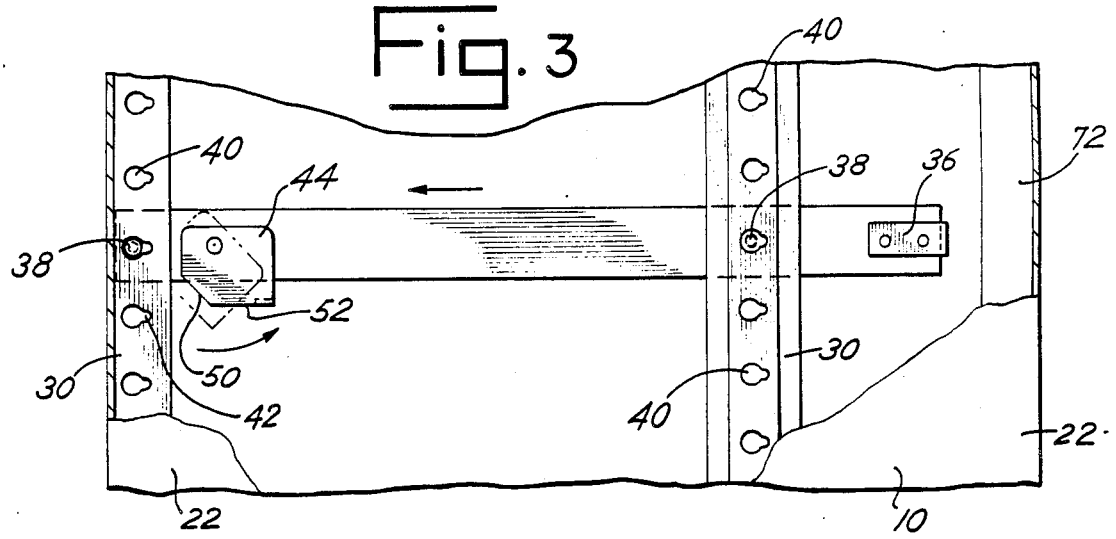
FIG. 3 is a second cut-away view of the same elements shown in FIG. 2, with the slide lock rotated to the release position.

In the detailed description, directional terms such as upper, lower, left, and right, and the like are used to relate the invention to the drawer and drawer slide mechanism shown in FIG. 1. Terms of this type are used for the convenience of person of ordinary skill in the art, and are not intended to limit the scope with any patent issuing on the present invention, unless expressly included in the claims.

The preferred embodiment of this invention is a removably drawer with a slide mechanism interlocking with that drawer for use in metal cabinetry and the like. As disclosed in this specification, the preferred embodiment is for use with such metal cabinets as are frequently used by machine shops, carpentry shops, or related facilities for holding tools, tool supplies, and similar materials.

Referring now to the drawings and referring in particular to FIG. 1, the preferred embodiment of the invention is adapted for use with a cabinet 10 having one or more drawers 12. Like all such drawers, each drawer 12 has a pull 14, a rear 16, a right side 18 and left side 20. Likewise, the cabinet has a right side 22 and a left side 24.

To mount the drawer 12 in the cabinet 10, each drawer has a pair of slides 26. The cabinet 10 has a support mechanism to hold the slides 26, comprising slide receivers 28 positioned by slide receiver supports 30. In the preferred embodiment, the front slide receiver support is also part of the structural frame for the cabinet 10.

The preferred embodiment in the invention includes a tongue and groove mounting of the slides 26 in the slide receivers 28. Accordingly, each slide 26 has one or more tongue portions 32 that mate within a groove 34 in each slide receiver 28. Also in the preferred embodiment, each slide receiver has an end stop 36 that prevents a slide 26 from moving beyond the internal end of any slide receiver 28.

Figure 4:
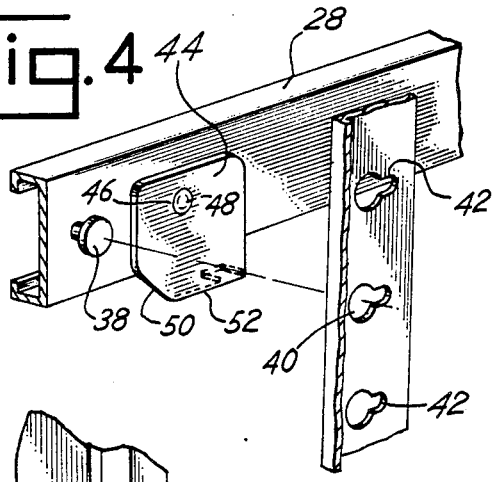
FIG. 4 is cut-away perspective view of a slide receiver and slide receiver support before insertion of a guide pin into the slide receiver support.
Figure 5:
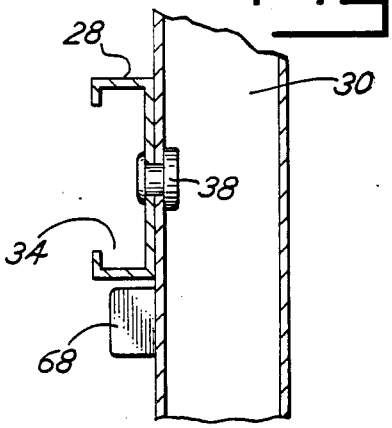
FIG. 5 is a cross sectional view along line 5—5 of FIG. 2 showing the slide receiver and slide receiver support.

Referring now to FIGS. 2–5, the details of the interaction between the slides, slide receivers and slide locks is disclosed. FIG. 2 specificly shows a drawer 12 fully inserted into a cabinet 10. In the preferred embodiment, the slide receivers 28 are held in the slide receiver supports 30 by means of a guide pin 38. As is best seen in FIGS. 4 & 5, each slide receiver support has a plurality of pin holes 40 that mate with the guide pins 38. Each pin hole 40 has a pin slot 42 extending transverse of the slide receiver supports. All pin slots 42 are oriented on the same side of the pin holes 40; in the preferred embodiment, the pin slots 42 are all to the rear of the pin holes 40. Mounting the slide receivers 28 in the slide receiver supports 30 is thus a matter of inserting the guide pins 38 into the appropriate pin holes 40, as best shown in FIG. 3. The slide receiver supports 30 are then moved rearward forcing the guide pins 38 into the pin slots 42, as is best shown in FIG. 2.

The mechanism for securing the slide receiver 28 in the slide receiver support 30, in the preferred embodiment, is a slide lock 44. The configuration of the slide 44 is best illustrated by FIGS. 12 and 13. Each slide lock 44 is pivotably mounted to slide receivers 28 through a pivot hole 46. The slide lock 44 is attached to the slide receiver 28 through the pivot hole 46 by use of a pivot pin 48 inserted through the pivot hole. Each slide lock 44 has a slanted side 50 and a lock side 52. The slide lock 44 is positioned on the slide receiver 28 so that the lock side 52 will be in flush contact with a slide receiver support 38 in one rotational position (known as a "lock" position). The slide lock 44 can also pivot away from the slide receiver 28 allowing movement of the guide pin 38 out of the pin slot 42 and into the pin holes 40. The slanted side 50 allows such rotation of the slide lock 44 without interference between the slide lock and the slide receiver. To prevent to slide lock 44 from moving merely due to gravity, the pivot pin 48 is constructed to maintain friction between the slide lock 44 and a slide receiver 28. Such friction can be maintained, for example, by using a bolt for the pivot 48 and tightening the bolt sufficient to produce the necessary friction.

Operation of the interlock between the drawers 12 and slide receivers 28 is best illustrated by reference to FIGS. 6–9. Each drawer preferrable has two drawer stops 54 mounted to interact with the slide lock 44. Details of the drawer stops 54 are shown in FIGS. 10–11. Each drawer stop 54 includes a ledge 56 and a drawer flange 58. Each drawer stop 54 also has a nose 60 with a slot 62. Finally, each drawer stop 54 has a bolt hole 64 adapted to allow a bolt 66 to mount the drawer stop to the rear 16 of the drawer 12.

Figure 6:
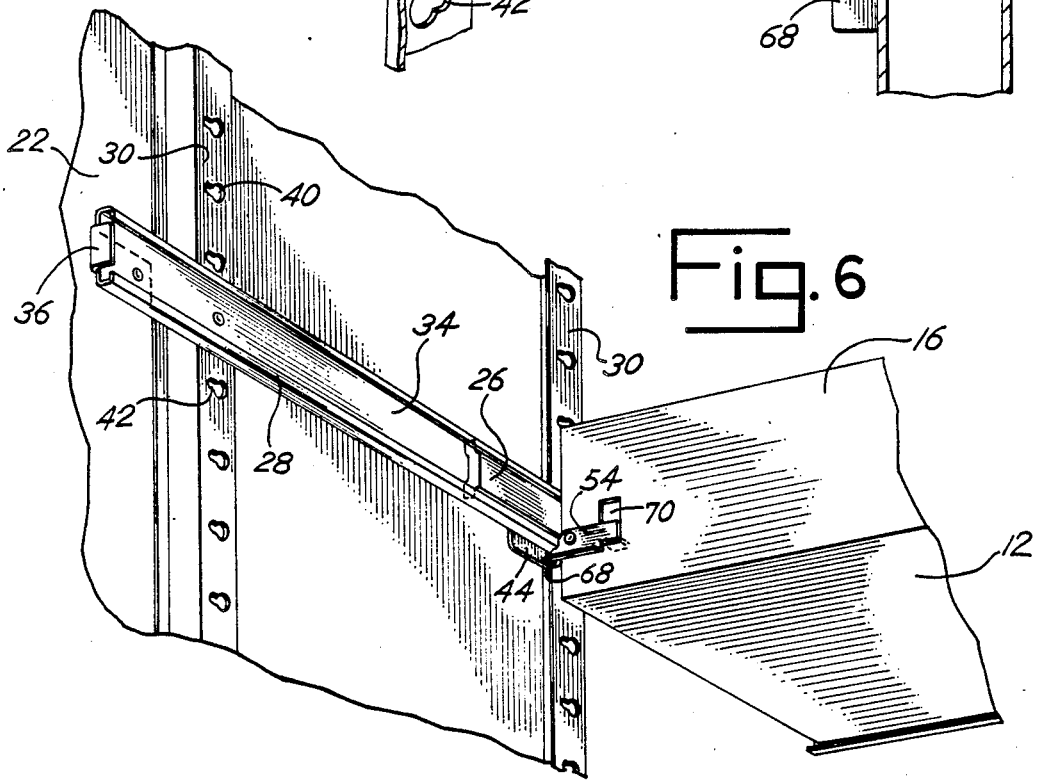
FIG. 6 is an internal perspective view looking from below the supports to a drawer, and showing the connection of a drawer stop to the drawer catch of a slide lock.

The interlock between the drawer 12 and the slide receiver 28 occurs through contact of the nose 60 with the slide lock 44. As best shown in FIG. 12, the slide lock 44 includes a drawer catch 68 that extends toward the drawer from the slide lock. When the drawer stop 54 is properly mounted, the nose 60 is in line with the drawer catch 68. As best shown in FIG. 6, the drawer 12 then cannot be pulled out of the cabinet 10 because the drawer is held in place by the force of the drawer catch 68 against the nose 60.

In the preferred embodiment, the drawer stop 54 can move between a catch position (illustrated in FIG. 8) and a release position illustrated in FIG. 9). The drawer stop 54 pivots about the bolt 66 mounted in the rear 16 of the drawer 12. To limit rotation of the drawer stop 54, the rear 16 of the drawer 12 has a pair of flange slots 70, one for each drawer stop. In the release position, the drawer flange 58 is held by the top of the flange slot 70, limiting the rotation of the drawer stop 54 (the drawer stop rotates clock wise as viewed in FIG. 9). In the catch position, the drawer flange 58 rests against the bottom of the flange slot 70, leaving the nose 60 in a direct line with the drawer catch 68.

Additional features of the drawer stop 54 include a slot 62 in the drawer stop, which allows the drawer 12 to move along the slide receiver 28 without having the drawer stop 54 rub against the corner of the slide receiver (as best illlustrated in FIG. 8). Additionaly, the drawer stop 54 has a ledge 56, providing additional strength to the nose portion. An alternative embodiment of the above described structure can be constructed with the slide receiver support made an integral part of the frame 72 of the cabinet 10. For example, referring to FIG. 1, the front slide receiver support of the cabinet 10 is part of the frame, while the rear slide receiver support is a seperately mounted element. Instead, the rear frame 72 can have the pin holes and pin slots placed directly thereon eliminating one of the elements.

Operation of the removeable drawer slide and interlock begins with installation of the slide receivers on to the slide support. As is readily noted, the slide receiver supports may be installed at any height that corresponds to the pin holes and pin slots. Thus, for example, a cabinet or other item of furniture can be construsted with several small drawers, or a few large drawers, or any combination of large and small drawers. In each instance, the slide 44 securely fastens the slide receiver 28 to a slide receiver support 30, thereby maintaining the guide pins 38 in the pins slots 42 rather than in the pin holes 40 (which would allow the guide pin to come out of the slide receiver supports 30).

Removal of a drawer 12 from the cabinet pin is simply a matter of reaching with one hand and moving the drawer stop 54 from the catch position to the release position. Since the slide lock 44 is always mounted on the slide receiver support at the front of the cabinet 10, release of the drawer from the interlock mechanism is readily accomplished because of the proximaty of the drawer stop and its related mechanism to the front of the cabinet when the drawer is pulled to its full extent forward and the nose 60 is in contact with drawer catch 68.

While the preferred embodiments of the present invention have been set forth in the above detailed description, the preferred embodiments are only examples of the invention. Other modifications may be used without departing from the scope of the present invention, and the invention is limited only by the following claims and their equivalents.

What is claimed is:

1. A drawer and interlocking drawer mechanism, comprising, in combination:

a drawer;

a pair of slides with one slide attached to each side of the drawer;

a pair of slide receivers mateable with the slides, each slide receiver having a pair of guide pins adapted to support the slide receiver;

a plurality of slide receiver supports each having a plurality of openings mateable with the guide pins such that when the guide pins are inserted into one of the openings in each support, the slide receivers are supported by the slide receiver supports;

a pair of slide locks rotatably mounted on each slide receiver and adapted to rotatably move between a lock position against one of the slide receiver supports and an open position away from the same support, each slide lock having a drawer catch; and a pair of drawer stops, each rotatably mounted on the drawer and adapted to rotate between a catch position where the drawer stop will catch the drawer catch at one point during movement of a slide in the slide receiver and a release position where the drawer stop will never catch the drawer catch during movement of the slides in the slide receivers, whereby the slide receivers are releasably held in fixed position by the slide locks, and the drawer may be removed from the slide receivers by rotating the drawer stops to the release position and withdrawing the drawer from the slide.

2. A drawer and interlocking drawer mechanism as claimed in claim 1, wherein the drawer stops further comprise a protruding flange, and the drawer further comprises one or more flange slots mateable with the drawer flange and adapted to limit rotation of the drawer stop.

3. A drawer and interlocking drawer mechanism as claimed in claim 1, wherein the slide lock further comprises a lock side adapted to contact a slide receiver support, and the drawer catch comprises a flange extending from the lock side of the slide lock.

4. A drawer and interlocking drawer mechanism as claimed in claim 1, wherein the drawer and mechanism are part of a cabinet having a frame, and one or more of the slide receiver supports acts as an element of that frame.

5. A drawer and interlocking drawer mechanism as claimed in claim 1, wherein the guide pins comprise a shaft with an enlarged head, and the openings in the slide receiver supports comprise a slot narrower than the head of the guide pins but wider than the shaft, with the slot being part of a pin hole that is wider than the guide pin heads, whereby the slide receivers are assembled to the slide receiver supports by inserting the enlarged head of the guide pins into the pin holes and thereafter sliding the shafts into the slots, such that movement of the slide receivers is limited to sliding movement along the slots.

6. A drawer and interlocking drawer mechanism as claimed in claim 5, wherein the slide lock operates by preventing movement of the slide receiver in the longitudinal direction of the slots.

7. A drawer and interlocking drawer mechanism as claimed in claim 1, wherein the slide receivers each further comprise an end stop limiting movement of the slides into the slide receivers.

* * * * *